US010648718B2

(12) United States Patent
Iuchi

(10) Patent No.: US 10,648,718 B2
(45) Date of Patent: May 12, 2020

(54) AIR CONDITIONING APPARATUS WITH COMPRESSOR DISCHARGE PRESSURE SENSING

(71) Applicant: Toshiba Carrier Corporation, Kawasaki-shi (JP)

(72) Inventor: Akira Iuchi, Fuji (JP)

(73) Assignee: Toshiba Carrier Corporation, Kawasaki-shi (JP)

( * ) Notice: Subject to any disclaimer, the term of this patent is extended or adjusted under 35 U.S.C. 154(b) by 81 days.

(21) Appl. No.: 15/915,595

(22) Filed: Mar. 8, 2018

(65) Prior Publication Data

US 2018/0283749 A1 Oct. 4, 2018

(30) Foreign Application Priority Data

Mar. 28, 2017 (JP) ..... 2017-063551

(51) Int. Cl.
*F25B 47/02* (2006.01)
*F25B 49/02* (2006.01)

(52) U.S. Cl.
CPC ..... *F25B 47/025* (2013.01); *F25B 49/02* (2013.01); *F25B 2313/0233* (2013.01);
(Continued)

(58) Field of Classification Search
CPC ..... F25B 47/02; F25B 47/025; F25B 2313/0233; F25B 2313/02331;
(Continued)

(56) References Cited

U.S. PATENT DOCUMENTS

2016/0178259 A1* 6/2016 Kimura ..... F25B 47/025 62/155
2016/0223236 A1* 8/2016 Kimura ..... F24F 3/065

FOREIGN PATENT DOCUMENTS

JP 63-318444 A 12/1988
JP 2006-292213 A 10/2006
(Continued)

OTHER PUBLICATIONS

Office Action dated Mar. 17, 2020, in Japanese Patent Application No. 2017-063551, filed Mar. 28, 2017, w/English-language Translation.

*Primary Examiner* — Jonathan Bradford
(74) *Attorney, Agent, or Firm* — Oblon, McClelland, Maier & Neustadt, L.L.P.

(57) ABSTRACT

According to one embodiment, an air conditioning apparatus has one or a plurality of indoor units, an outdoor unit, and a controller. The one or plurality of indoor units have an indoor heat exchanger, and an indoor expansion valve in which a degree of opening is variable. The outdoor unit has an outdoor heat exchanger, a four-way valve, a compressor, and a discharge pressure sensor configured to detect a pressure of a refrigerant discharged from the compressor. When a discharge pressure detected by the discharge pressure sensor is less than a predetermined pressure threshold value while a heating operation is performed, the controller sets a maximum time for continuing a defrosting operation started by a start condition of the defrosting operation being satisfied to be shorter than a maximum time for continuing the defrosting operation when the discharge pressure is equal to or higher than the pressure threshold value.

3 Claims, 6 Drawing Sheets

(52) U.S. Cl.
CPC ... *F25B 2313/0315* (2013.01); *F25B 2500/31* (2013.01); *F25B 2600/01* (2013.01); *F25B 2700/1931* (2013.01); *F25B 2700/1933* (2013.01); *F25B 2700/2106* (2013.01)

(58) Field of Classification Search
CPC .. F25B 2313/02332; F25B 2313/02334; F25B 2347/02; F25B 2600/01; F25B 2700/11; F25B 2700/1931; F24F 11/41; F24F 11/42
See application file for complete search history.

(56) References Cited

FOREIGN PATENT DOCUMENTS

| | | |
|---|---|---|
| JP | 2008-241121 A | 10/2008 |
| JP | 2014-194310 | 10/2014 |
| JP | 2014-194311 | 10/2014 |

* cited by examiner

AIR CONDITIONING APPARATUS WITH COMPRESSOR DISCHARGE PRESSURE SENSING

CROSS-REFERENCE TO RELATED APPLICATION

This application is based upon and claims the benefit of priority from Japanese Patent Application No. 2017-063551, filed Mar. 28, 2017; the entire contents of which are incorporated herein by reference.

FIELD

Embodiments described herein relate generally to an air conditioning apparatus.

BACKGROUND

A so-called separate type air conditioning apparatus in which an indoor unit and an outdoor unit are connected to each other via a refrigerant pipe (crossover pipe) is known. When performing a heating operation with this type of air conditioner, an indoor heat exchanger mounted on the indoor unit has a relatively high temperature, and an outdoor heat exchanger mounted on the outdoor unit has a relatively low temperature. When the outside air temperature is low, the temperature of the outdoor heat exchanger becomes 0° C. or less. When the humidity around the outdoor heat exchanger is high to a certain extent, moisture in the outside air becomes frost and adheres to the outdoor heat exchanger.

Therefore, when the heating operation is continued even after adherence of frost, there arises a problem in which frost increases, the heat exchange capacity of the outdoor heat exchanger is degraded, and the heating capacity of the air conditioning apparatus drops.

In order to prevent heating capacity degradation, when it can be presumed that the frost adhering to the outdoor heat exchanger has increased to a certain extent, a controller of the air conditioning apparatus executes an operation (a defrosting operation) for melting the adhered frost.

When the outside air temperature is extremely low, for example, −20° C. or less, humidity is low and it is difficult for frost to adhere to the outdoor heat exchanger. Even in this case, since the temperature of the outdoor heat exchanger is low, the defrosting operation is performed. Under such conditions, when the defrosting operation is performed for a long period of time, it is conceivable that problems may occur in the air conditioning apparatus.

DETAILED DESCRIPTION

Hereinafter, the air conditioning apparatus of the embodiment will be described with reference to the drawings.

According to one embodiment, an air conditioning apparatus has one or a plurality of indoor units, an outdoor unit, and a controller. The one or plurality of indoor units have an indoor heat exchanger, and an indoor expansion valve in which a degree of opening is variable. The outdoor unit has an outdoor heat exchanger, a four-way valve, a compressor, and a discharge pressure sensor configured to detect a pressure of a refrigerant discharged from the compressor. The controller controls the indoor expansion valve, the four-way valve, and the compressor. The one or plurality of indoor units are connected in parallel to the outdoor unit. When a discharge pressure detected by the discharge pressure sensor is less than a predetermined pressure threshold value while a heating operation is performed, the controller sets a maximum time for continuing a defrosting operation started by a start condition of the defrosting operation being satisfied to be shorter than a maximum time for continuing the defrosting operation when the discharge pressure is equal to or higher than the pressure threshold value.

First Embodiment

Figure 1:
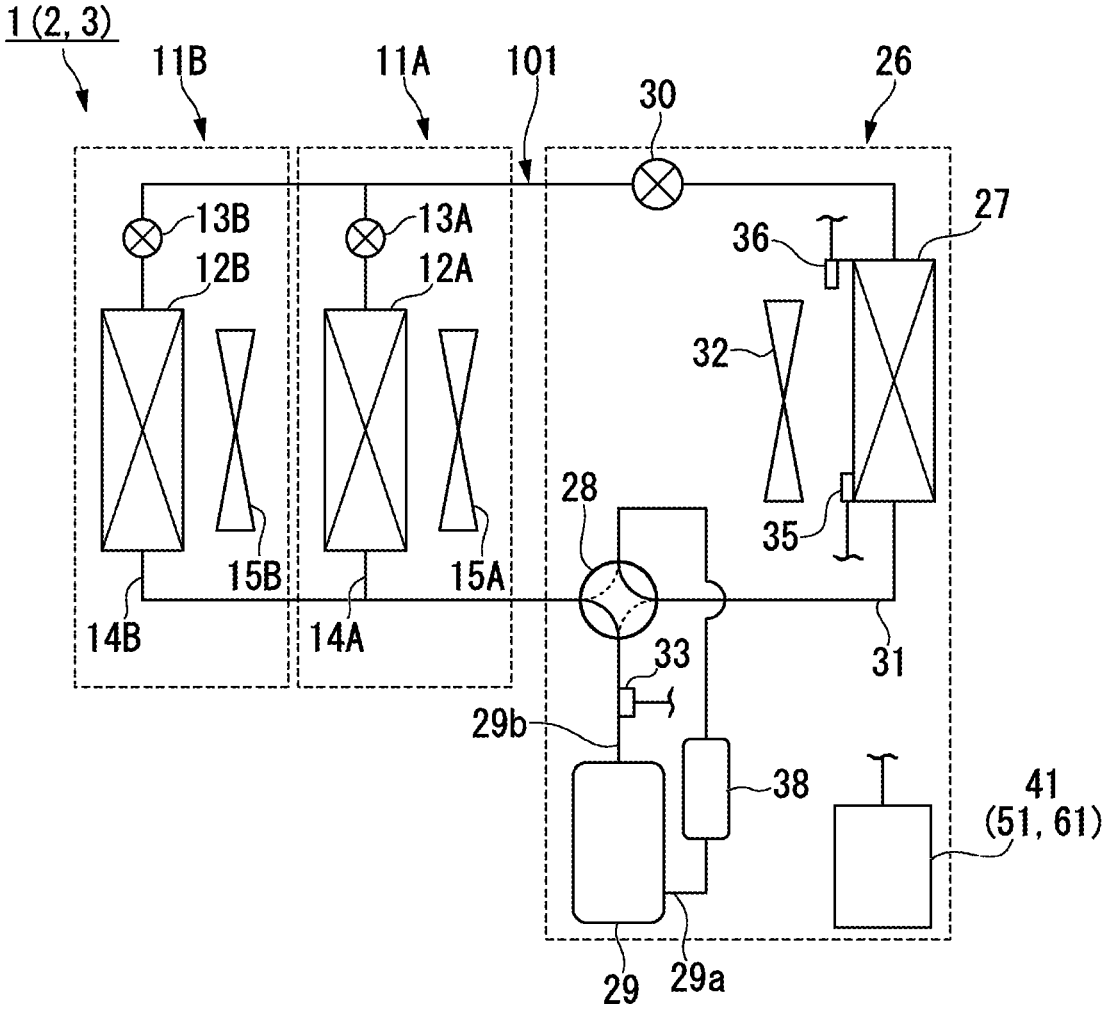
FIG. 1 is a schematic configuration diagram showing an air conditioning apparatus according to a first embodiment.

As shown in FIG. 1, the air conditioning apparatus 1 of the present embodiment includes two indoor units of a first indoor unit (indoor unit) 11A and a second indoor unit (indoor unit) 11B, an outdoor unit 26, and a controller 41.

In the present embodiment, the configuration of the first indoor unit 11A and the configuration of the second indoor unit 11B are the same. For this reason, the configuration of the first indoor unit 11A is indicated by appending a capital letter 'A' to the number. The configuration of the second indoor unit 11B corresponding to the first indoor unit 11A is indicated by appending a capital letter 'B' to the same number as that of the first indoor unit 11A. Thus, redundant description of the second indoor unit 11B will be omitted.

For example, an indoor heat exchanger 12A of the first indoor unit 11A and an indoor heat exchanger 12B of the second indoor unit 11B, which will be described later, may have the same configuration. Further, the indoor heat exchanger 12A and the indoor heat exchanger 12B may not have the same configuration. The same also applies to the indoor expansion valves 13A and 13B, indoor pipes 14A and 14B, and the like which will be described later.

The first indoor unit 11A includes an indoor heat exchanger 12A, an indoor expansion valve 13A, an indoor pipe 14A, and an indoor blower 15A.

For example, the indoor heat exchanger 12A may be a fin tube type heat exchanger.

For example, the indoor expansion valve 13A may be an electronic expansion valve (PMV: Pulse Motor Valve).

A degree of opening of the indoor expansion valve 13A is variable. For example, as the degree of opening of the indoor expansion valve 13A increases, the refrigerant flows more easily through the inside of the indoor expansion valve 13A. As the degree of opening of the indoor expansion valve 13A decreases, it becomes more difficult for the refrigerant to flow through the inside of the indoor expansion valve 13A.

For example, R410A, R32, or the like can be used as a refrigerant. Refrigerating machine oil or the like is included in the refrigerant.

As shown in FIG. 1, the indoor pipe 14A connects the indoor heat exchanger 12A and the indoor expansion valve 13A.

For example, the indoor blower 15A may have a centrifugal fan. The fan of the indoor blower 15A is disposed to face the indoor heat exchanger 12A.

The indoor expansion valve 13A and the indoor blower 15A are connected to the controller 41 and are controlled by the controller 41.

The second indoor unit 11B has an indoor heat exchanger 12B, an indoor expansion valve 13B, an indoor pipe 14B, and an indoor blower 15B configured in the same manner as the indoor heat exchanger 12A, the indoor expansion valve 13A, the indoor pipe 14A, and the indoor blower 15A.

The outdoor unit 26 has an outdoor heat exchanger 27, a four-way valve 28, a compressor 29, an outdoor expansion valve 30, an outdoor pipe 31, an outdoor blower 32, a discharge pressure sensor 33, a heat exchanger temperature sensor 35, and an outside air temperature sensor (a temperature sensor) 36.

For example, the outdoor heat exchanger 27 may be a fin tube type heat exchanger.

The four-way valve 28 can switch the direction of the refrigerant flowing through the inside of the air conditioning apparatus 1 to a direction of a heating operation flow, and directions of cooling operation and defrosting operation flows which will be described later.

The compressor 29 suctions the refrigerant from a suction port 29*a* and compresses the refrigerant in the compressor 29. The compressor 29 discharges the compressed refrigerant outside from a discharge port 29*b*.

An accumulator 38 for accumulating the liquid refrigerant is attached to the suction port 29*a* of the compressor 29.

The outdoor expansion valve 30 is configured in the same manner as the indoor expansion valve 13A. The degree of opening of the outdoor expansion valve 30 is variable.

The outdoor pipe 31 connects the outdoor expansion valve 30, the outdoor heat exchanger 27, the four-way valve 28, the compressor 29, and the accumulator 38.

The first indoor unit 11A and the second indoor unit 11B are connected in parallel to the outdoor unit 26 via a crossover pipe 101.

The outdoor blower 32 is configured in the same manner as the indoor blower 15A.

The discharge pressure sensor 33 detects the pressure of the refrigerant discharged from the compressor 29. In this example, the discharge pressure sensor 33 detects the pressure of the refrigerant at the discharge port 29*b* of the compressor 29. Hereinafter, the pressure of the refrigerant detected by the discharge pressure sensor 33 is referred to as a discharge pressure.

For example, the heat exchanger temperature sensor 35 is attached to a pipe or the like of the outdoor heat exchanger 27. The heat exchanger temperature sensor 35 detects the temperature of the outdoor heat exchanger 27.

For example, the outside air temperature sensor 36 is disposed in a place inside the outdoor unit 26 that is not easily affected by radiant heat or the like of the outdoor heat exchanger 27. The outside air temperature sensor 36 detects the temperature of the outside air of the outdoor unit 26. Hereinafter, the temperature of the outside air of the outdoor unit 26 detected by the outside air temperature sensor 36 is simply referred to as an outside air temperature.

The four-way valve 28, the compressor 29, the outdoor expansion valve 30, the outdoor blower 32, the discharge pressure sensor 33, the heat exchanger temperature sensor 35, and the outside air temperature sensor 36 are connected to the controller 41. The four-way valve 28, the compressor 29, the outdoor expansion valve 30, and the outdoor blower 32 are controlled by the controller 41.

The discharge pressure sensor 33 transmits a signal representing the detected pressure to the controller 41. The heat exchanger temperature sensor 35 and the outside air temperature sensor 36 transmit a signal representing the detected temperature to the controller 41.

Figure 2:
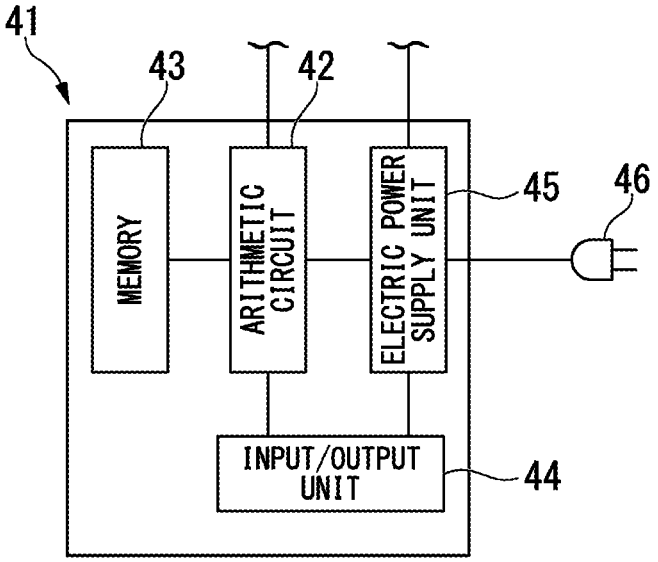
FIG. 2 is a schematic configuration diagram showing a controller of the air conditioning apparatus of the first embodiment.

As shown in FIG. 2, the controller 41 has an arithmetic circuit 42, a memory 43, an input/output unit 44, an electric power supply unit 45, and the like.

The arithmetic circuit 42 includes a CPU (Central Processing Unit), a timer, and the like.

The memory 43 includes a RAM (Random Access Memory) and the like. The memory 43 stores a control program for controlling the arithmetic circuit 42, a predetermined pressure threshold value P1, a temperature threshold value T1, each of reference times, each of maximum times, a start condition of a defrosting operation, and the like. For example, the pressure threshold value P1 may be 1 MPa (megapascal). The pressure is indicated by a gauge pressure based on the atmospheric pressure. That is, 0 MPa means atmospheric pressure.

For example, the temperature threshold value T1 may be 0° C.

As shown in Table 1, the memory 43 stores a first reference time and a second reference time as the reference times. The first maximum time, the second maximum time and the like are stored as the maximum times.

TABLE 1

| Kind of reference time or maximum time | Length of each time | Notes |
|---|---|---|
| First reference time | 40 min | When discharge pressure is equal to or higher than pressure threshold value |
| First maximum time | 15 min | |
| Second reference time | 20 min | When discharge pressure is less than pressure threshold value |
| Second maximum time | 5 min | |
| Third maximum time | 90 min | — |
| Fourth reference time | 15 min | — |
| Fourth maximum time | 3 min | — |

For example, the length of the first reference time may be 40 minutes, and the length of the second reference time may be 20 minutes. For example, the length of the first maximum time may be 15 minutes, and the length of the second maximum time may be 5 minutes.

The first reference time and the first maximum time are values which are used when the discharge pressure is equal to or higher than the pressure threshold value. The second reference time and the second maximum time are values which are used when the discharge pressure is less than the pressure threshold value.

For example, the start condition of the defrosting operation may be a condition in which a total value of the period during which the outside air temperature is less than the temperature threshold value T1 from the start of the heating operation becomes the first reference time. When the start condition of the defrosting operation is satisfied, the controller 41 starts the defrosting operation.

Further, the start condition of the defrosting operation is not limited to the outside air temperature, and may be determined on the basis of the temperature detected by the heat exchanger temperature sensor 35 or the like.

Although it is not shown, the input/output unit 44 includes an input unit such as a keyboard, a button, or a dip switch for giving instructions to the arithmetic circuit, and an output unit such as a liquid crystal display or an LED lamp for displaying the results calculated by the arithmetic circuit and the like.

An electric power supply unit 45 includes a transformer, a switching circuit, and the like (not shown). Electric power such as AC (alternating current) 200 V is supplied as AC electric power to the transformer via a plug 46 or the like.

The transformer adjusts the voltage of the AC electric power. The switching circuit converts AC electric power into DC power. The electric power supply unit 45 is connected to the arithmetic circuit 42 and controlled by the arithmetic circuit 42.

For example, when a plug 46 is inserted into an outlet (not shown), the AC electric power is adjusted with a transformer. The adjusted AC electric power is converted into DC power by the switching circuit and supplied to the arithmetic circuit 42.

The arithmetic circuit 42 supplies the AC electric power to the indoor blowers 15A and 15B, the compressor 29, and the outdoor blower 32 on the basis of the control content of the control program, or supplies the DC electric power to the indoor expansion valves 13A and 13B, the four-way valve 28, and the outdoor expansion valve 30.

Figure 3A:
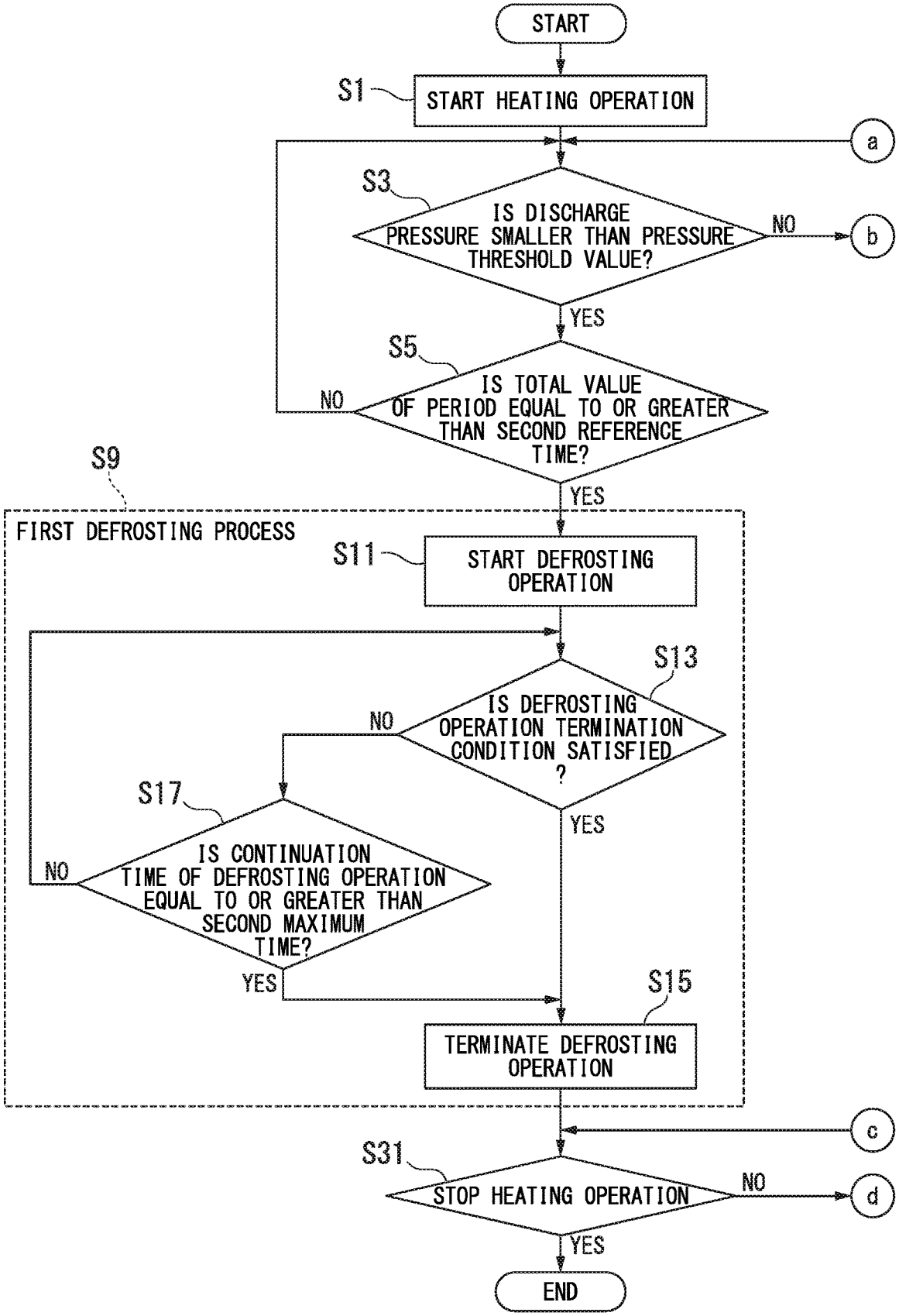
FIG. 3A is a flowchart for explaining the operation of the air conditioning apparatus of the first embodiment.
Figure 3B:
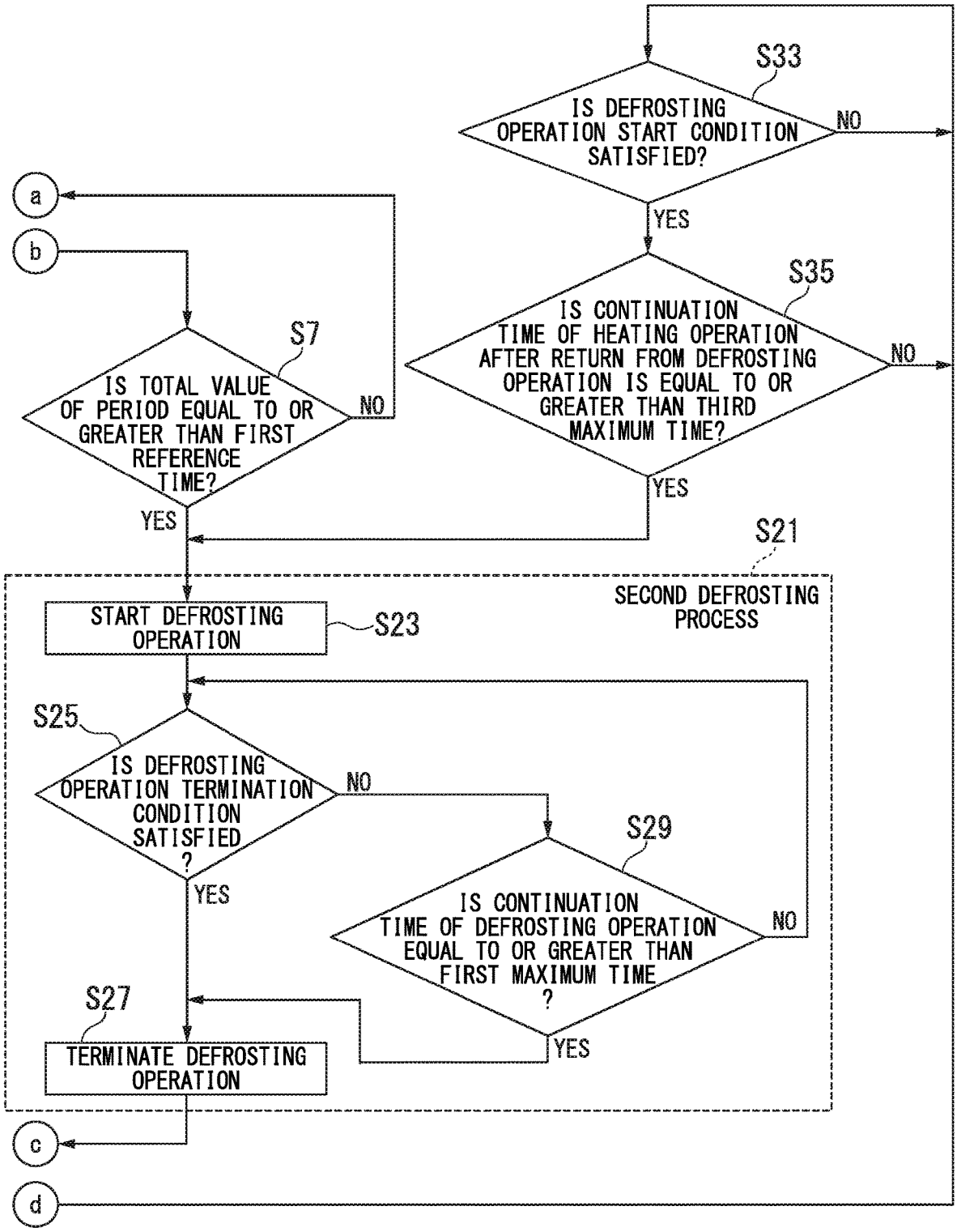
FIG. 3B is a flowchart for explaining the operation of the air conditioning apparatus of the first embodiment.

Next, the operation of the air conditioning apparatus 1 configured as described above will be described. FIGS. 3A and 3B are flowcharts for explaining the operation of the air conditioning apparatus 1.

First, the user inserts the plug 46 of the air conditioning apparatus 1 into the outlet. The supply of electric power to the controller 41 is started. The DC electric power converted by the electric power supply unit 45 is supplied to the arithmetic circuit 42, and the arithmetic circuit 42 operates. The arithmetic circuit 42 reads the control program, the pressure threshold value, and the like stored in the memory 43.

Figure 4:
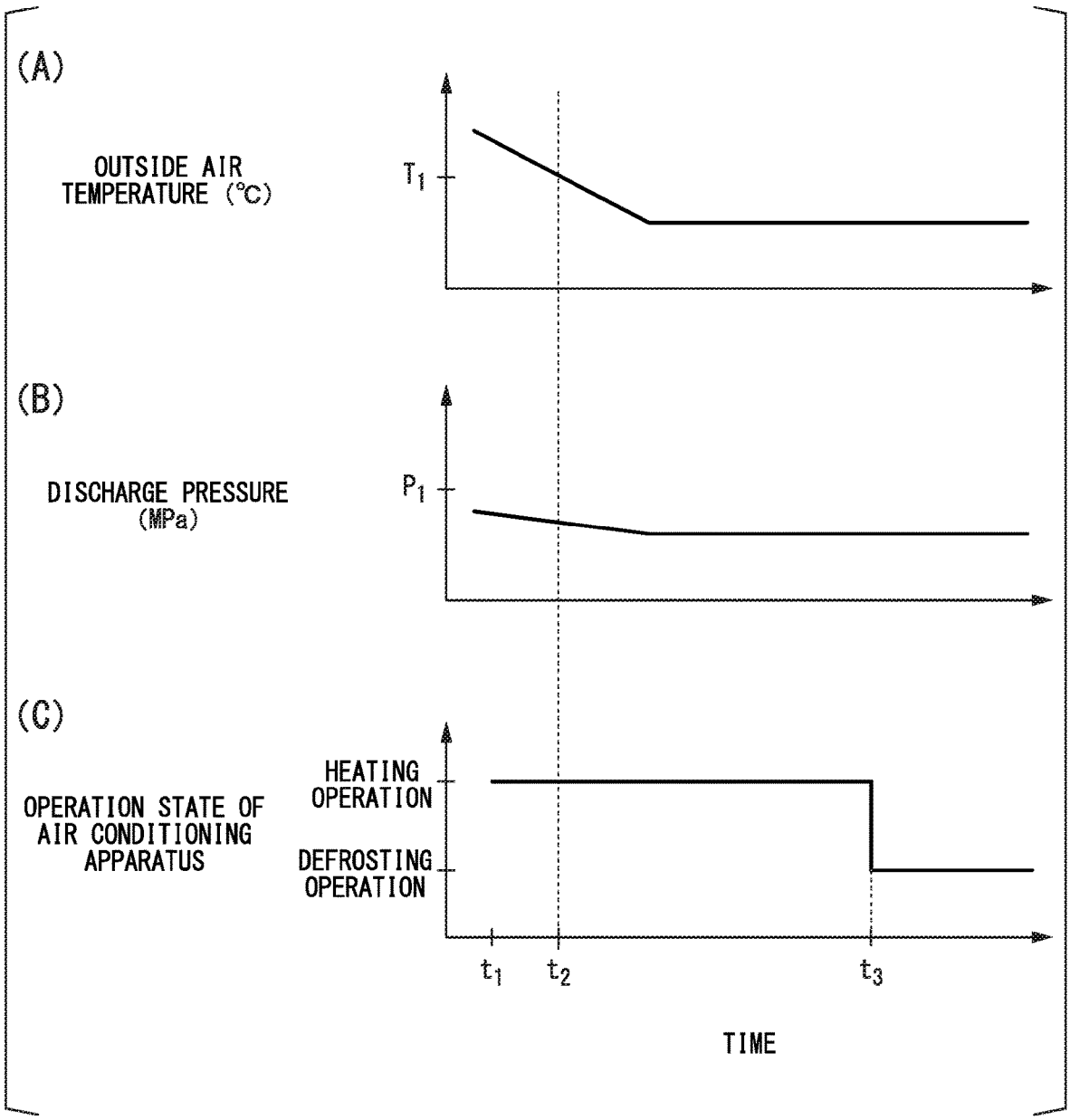
FIG. 4 is a diagram showing changes in outside air temperature, pressure, and operating condition with respect to time in the air conditioning apparatus of the first embodiment.

In step S1 (see FIG. 3A), the user manipulates the input unit at time t1 shown in FIG. 4 and instructs the arithmetic circuit 42 of the controller 41 to start the heating operation. The horizontal axes of FIGS. 4(A) to 4(C) represent the time. The vertical axis of FIG. 4(A) represents the outside air temperature. The vertical axis of FIG. 4(B) represents the discharge pressure, and the vertical axis of FIG. 4(C) represents the operation states of the air conditioning apparatus 1, such as the heating operation and the defrosting operation.

The arithmetic circuit 42 makes the four-way valve 28 available for the heating operation. The arithmetic circuit 42 supplies the AC electric power to the compressor 29, the outdoor blower 32, and the indoor blowers 15A and 15B, and starts the operation of the compressor 29, the outdoor blower 32, and the indoor blowers 15A and 15B. The arithmetic circuit 42 supplies the DC electric power to the outdoor expansion valve 30 and the indoor expansion valves 13A and 13B and thereby causes the outdoor expansion valve 30 and the indoor expansion valves 13A and 13B to have a predetermined degree of opening.

The high-temperature and high-pressure refrigerant compressed by the compressor 29 is discharged from the discharge port 29*b*. The refrigerant flows into the four-way valve 28, the indoor heat exchangers 12A and 12B of the indoor units 11A and 11B, and the indoor expansion valves 13A and 13B. As the refrigerant condenses in the indoor heat exchangers 12A and 12B, the indoor heat exchangers 12A and 12B function as condensers. Since the air sent from the indoor blowers 15A and 15B exchanges heat with the indoor heat exchangers 12A and 12B, the room in which the indoor units 11A and 11B are installed is warmed up.

The refrigerant expands inside the indoor expansion valves 13A and 13B, further expands in the outdoor expansion valve 30, and the temperature and the pressure are lowered. The refrigerant expanded in the outdoor expansion valve 30 flows into the outdoor heat exchanger 27. Since the refrigerant evaporates in the outdoor heat exchanger 27, the outdoor heat exchanger 27 functions as an evaporator. Since the air sent from the outdoor blower 32 exchanges heat with the outdoor heat exchanger 27, the outdoor heat exchanger 27 exchanges heat with the outside air.

Frost adheres to the outdoor heat exchanger 27 due to conditions such as the temperature or humidity of the outside air.

The refrigerant evaporated in the outdoor heat exchanger 27 flows through the four-way valve 28 and the accumulator 38, and is suctioned again into the compressor 29 from the suction port 29*a*.

The arithmetic circuit 42 of the controller 41 detects the pressure with the discharge pressure sensor 33 at predetermined time intervals, and detects the temperature with the temperature sensors 35 and 36.

At the beginning of starting the heating operation with the air conditioning apparatus 1, the start condition of the defrosting operation is a condition in which the total value of the period during which the outside air temperature is less than the temperature threshold value T1 from the start of the heating operation is equal to or higher than a first reference time which is, for example, 40 minutes. The maximum time for continuing the defrosting operation is the first maximum time which is, for example, 15 minutes.

In step S3, the arithmetic circuit 42 determines whether the discharge pressure is less than the pressure threshold value P1. In step S3, if the arithmetic circuit 42 determines that the discharge pressure is less than the pressure threshold value P1 (Yes), the process proceeds to step S5. On the other hand, if the arithmetic circuit 42 determines that the discharge pressure is equal to or higher than the pressure threshold value P1 (No) in step S3, the process proceeds to step S7 (see FIG. 3B). When it is determined as Yes in step S3, if the outside air temperature is very low, for example, −20° C. or less, in some cases, the discharge pressure is hard to rise, the absolute humidity is also low, and the frost is hard to adhere to the outdoor heat exchanger 27.

As shown in FIG. 4(A), it is assumed that the outside air temperature decreases from the time t1, for example, the outside air temperature is lowered to a temperature less than the temperature threshold value T1 at the time t2 after 10 minutes from the time t1. When the outside air temperature becomes less than the temperature threshold value T1 from the start of the heating operation at the time t2, the arithmetic circuit 42 starts the totaling of the period during which the outside air temperature is less than the temperature threshold value T1 with the timer. As shown in FIG. 4(B), it is assumed that a state in which the discharge pressure is less than the pressure threshold value P1 continues.

In step S3, when it is determined that the discharge pressure is less than the pressure threshold value P1, the arithmetic circuit 42 sets the first reference time to a second reference time shorter than the first reference time. The arithmetic circuit 42 shortens the maximum time for continuing the defrosting operation from the first maximum time to the second maximum time.

That is, until Yes is determined in step S3, if the first reference time for the total value of the period during which the outside air temperature is less than the temperature threshold value T1, which is, for example, 40 minutes has not elapsed from the start of the heating operation, the arithmetic circuit 42 does not start the defrosting operation. In contrast, when Yes is determined in step S3, if the second reference time for the total value of the period during which the outside air temperature is less than the temperature threshold value T1, which is, for example, 20 minutes has elapsed from the start of the heating operation, the arithmetic circuit 42 starts the defrosting operation. The arithmetic circuit 42 shortens the maximum time for continuing the defrosting operation from the first maximum time which is, for example, 15 minutes to the second maximum time which is, for example, 5 minutes.

A case where the discharge pressure is less than the pressure threshold value P1 while performing the heating operation referred to herein includes one of a case where the discharge pressure is temporarily less than the pressure threshold value P1 while the heating operation is being performed, and a case where the discharge pressure is less than the pressure threshold value P1 over the entire period during which the heating operation is performed.

Further, when the discharge pressure is equal to or higher than the pressure threshold value P1 at all times while the heating operation is being performed, the arithmetic circuit 42 does not change the first reference time, and does not change the maximum time for continuing the defrosting operation from the first maximum time.

In step S5, the arithmetic circuit 42 of the controller 41 determines whether or not the total value of the period during which the outside air temperature is less than the temperature threshold value T1 is equal to or higher than the second reference time after the start of the heating operation. In step S5, when the arithmetic circuit 42 determines that the total value of the period is equal to or higher than the second reference time (Yes), the start condition of the defrosting operation is satisfied at time t3 shown in FIG. 4(C). The arithmetic circuit 42 proceeds to the first defrosting process in step S9. The time t3 is the time at which the second reference time has elapsed from the time t2. For example, the second reference time is 20 minutes.

On the other hand, if the arithmetic circuit 42 determines that the total value of the period is less than the second reference time (No) in step S5, the heating operation is continued, and the process proceeds to step S3.

At this time, since the outside air temperature and the discharge pressure are low, even if the heating operation is continued, it is usually difficult to raise the pressure to a pressure at which frost can be melted until a predetermined time (time when the discharge pressure is equal to or higher than the pressure threshold value P1). Furthermore, in order to prevent the progress of adhesion of frost in a state in which it is difficult to melt the frost adhering to the outdoor heat exchanger 27, the second reference time is set to a time shorter than a normal first reference time (for example, 40 minutes).

In step S11 of the first defrosting process S9, the arithmetic circuit 42 starts the defrosting operation.

The arithmetic circuit 42 makes the four-way valve 28 available for the defrosting operation (cooling operation). The arithmetic circuit 42 stops the operation of the outdoor blower 32 and the indoor blowers 15A and 15B.

The defrosting operation of the air conditioning apparatus 1 does not necessarily mean that the outdoor heat exchanger 27 melts the frost. When the air conditioning apparatus 1 performs the defrosting operation, the air conditioning apparatus 1 causes the refrigerant to flow through the four-way valve 28 and the like in the same order as in the cooling operation, and the outdoor blower 32 and the indoor blowers 15A and 15B basically stop operating.

The high-temperature and high-pressure refrigerant compressed by the compressor 29 is discharged from the discharge port 29*b* and flows into the four-way valve 28 and the outdoor heat exchanger 27. As the refrigerant condenses in the outdoor heat exchanger 27, the outdoor heat exchanger 27 functions as a condenser. The frost adhered to the outdoor heat exchanger 27 is melted due to the heat generated by the condensation of the refrigerant.

The refrigerant condensed in the outdoor heat exchanger 27 is expanded in the outdoor expansion valve 30 and the indoor expansion valves 13A and 13B, and the temperature and pressure are lowered. The refrigerant expanded in the indoor expansion valves 13A and 13B flows in the indoor heat exchangers 12A and 12B. Since the indoor blowers 15A and 15B stop the operation, the amount of heat exchanged by the refrigerant in the indoor heat exchangers 12A and 12B is small.

The refrigerant flowing out from the indoor heat exchangers 12A and 12B flows into the four-way valve 28 and the accumulator 38, and is suctioned into the compressor 29 from the suction port 29*a* again.

In step S13, the arithmetic circuit 42 determines whether or not a termination condition of the defrosting operation, in which the frost of the outdoor heat exchanger 27 is assumed to be completely melted, is satisfied. For example, the termination condition of the defrosting operation may be defined on the basis of the temperature detected by the heat exchanger temperature sensor 35 and the pressure detected by the discharge pressure sensor 33.

When the arithmetic circuit 42 determines that the termination condition of the defrosting operation is satisfied (Yes) in step S13, the process proceeds to step S15. On the other hand, when the arithmetic circuit 42 determines that the termination condition of the defrosting operation is not satisfied (No) in step S15, the process proceeds to step S17 and the defrosting operation is continued.

In step S15, the arithmetic circuit 42 terminates the defrosting operation and terminates the first defrosting process S9.

In step S17, the arithmetic circuit 42 determines whether or not the duration of the defrosting operation is equal to or longer than the second maximum time which is, for example, 5 minutes. When the arithmetic circuit 42 determines that the duration of the defrosting operation is equal to or longer than the second maximum time (Yes) in step S17, the process proceeds to step S15. On the other hand, when the arithmetic circuit 42 determines that the duration of the defrosting operation is less than the second maximum time (No) in step S17, the process proceeds to step S13.

At this time, since the discharge pressure before starting the defrosting operation was in a low state, the termination condition of the defrosting operation is not satisfied and the duration of the defrosting operation tends to be the second maximum time. For this reason, the arithmetic circuit 42 sets the second maximum time to be shorter than the first maximum time (for example, 15 minutes) of a normal state (a state in which the discharge pressure is high) to be described later so that the defrosting operation is not wastefully performed for a long time.

As shown in FIG. 3B, in step S7 progressing from step S3, the arithmetic circuit 42 of the controller 41 determines whether or not the total value of the period during which the outside air temperature is lower than the temperature threshold value T1 is equal to or greater than the first reference time which is, for example, 40 minutes, from the start of the heating operation. If the arithmetic circuit 42 determines that the total value of the period is equal to or greater than the first reference time in step S7 (Yes), the start condition of the defrosting operation is satisfied, and the process proceeds to the second defrosting process of step S21. On the other hand, if the arithmetic circuit 42 determines that the total value of the period is less than the first reference time (No) in step S7, the heating operation is continued and the process proceeds to step S3 (see FIG. 3A).

In step S23 of the second defrosting process S21, the arithmetic circuit 42 starts the defrosting operation as in step S11. When step S23 is terminated, the process proceeds to step S25.

In step S25, the arithmetic circuit 42 determines whether or not the termination condition of the defrosting operation is satisfied. If the arithmetic circuit 42 determines that the termination condition of the defrosting operation is satisfied (Yes) in step S25, the process proceeds to step S27. On the other hand, if the arithmetic circuit 42 determines that the termination condition of the defrosting operation is not satisfied (No) in step S25, the process proceeds to step S29 and the defrosting operation is continued.

In step S27, the arithmetic circuit 42 terminates the defrosting operation, and terminates the second defrosting process S21.

In step S29, the arithmetic circuit 42 determines whether or not the duration of the defrosting operation is equal to or longer than the first maximum time of, for example, 15 minutes. If the arithmetic circuit 42 determines that the duration of the defrosting operation is equal to or longer than the first maximum time (Yes) in step S29, the process proceeds to step S27. On the other hand, if the arithmetic circuit 42 determines that the duration of the defrosting operation is less than the first maximum time (No) in step S29, the process proceeds to step S25.

In step S27, the arithmetic circuit 42 terminates the defrosting operation and terminates the second defrosting process S21.

In step S31 shown in FIG. 3A progressing from the first defrosting process S9 and the second defrosting process S21, the arithmetic circuit 42 of the controller 41 determines whether or not a stopping instruction for the heating operation has been issued. If the arithmetic circuit 42 determines that the stopping instruction for the heating operation has been issued (Yes) in step S31, the processes of the heating and defrosting operations of the air conditioning apparatus 1 are terminated. In this case, the arithmetic circuit 42 stops the operation of the compressor 29.

On the other hand, if the arithmetic circuit 42 determines that the stopping instruction for the heating operation has not been issued (No) in step S31, the heating operation is continued and the process proceeds to step S33 shown in FIG. 3B.

In step S33, the arithmetic circuit 42 determines whether or not the start condition of the defrosting operation is satisfied. For example, the start condition of the defrosting operation is determined on the basis of the temperatures detected by the heat exchanger temperature sensor 35 and the outside air temperature sensor 36. If the arithmetic circuit 42 determines that the start condition of the defrosting operation is satisfied (Yes) in step S33, the process proceeds to step S35. On the other hand, if the arithmetic circuit 42 determines that the start condition of the defrosting operation is not satisfied (No) in step S33, the process proceeds to step S33.

In step S35, the arithmetic circuit 42 determines whether or not the duration of the heating operation after the return from the defrosting operation is equal to or longer than a predetermined third maximum time. For example, the third maximum time is 90 minutes. If the arithmetic circuit 42 determines that the duration of the heating operation is equal to or longer than the third maximum time (Yes) in step S35, the process proceeds to the second defrosting process S21. On the other hand, if the arithmetic circuit 42 determines that the duration of the heating operation is less than the third maximum time (No) in step S35, the process proceeds to step S33.

As described above, in general, when the outside air temperature of the outdoor unit is extremely low, for example, −20° C. or less, the discharge pressure becomes a low value that is less than the pressure threshold value. At this outside air temperature, even if the heating operation is performed, it is difficult to heat the interior of the building with the indoor unit. Since the absolute humidity of the outside air is low, the amount of frost adhering to the outdoor heat exchanger is not so large. Further, the defrosting operation is a special operation state, unlike the heating operation and the cooling operation.

In the air conditioning apparatus 1 of the present embodiment, by shortening the maximum time for continuing the defrosting operation which is a special operation state, in a state in which the outside air temperature is very low and the amount of frost adhering to the outdoor heat exchanger 27 is not so large, it is possible to secure reliability in the defrosting operation of the air conditioning apparatus 1.

While the air conditioning apparatus 1 performs the defrosting operation, the interior of the building cannot be heated by performing the heating operation. By shortening the maximum time for continuing the defrosting operation, it is possible to reduce discomfort caused to the user who uses the room.

When the discharge pressure is less than the pressure threshold value P1 while performing the heating operation, the controller 41 sets the first reference time to a second reference time shorter than the first reference time. When the outside air temperature of the outdoor unit 26 is extremely low, the amount of the refrigerating machine oil in the refrigerant discharged from the compressor 29 increases.

By decreasing the total value of the period from the start of the heating operation, which is the start condition of the defrosting operation, the heating operation is terminated earlier, and it is possible to refresh the state of the compressor 29 from which a lot of refrigerating machine oil is discharged.

As the start condition of the defrosting operation, the total value of the period during which the outside air temperature is less than the temperature threshold value T1 from the start of the heating operation is used. Except for the case where the outside air temperature is very low, generally, when the outside air temperature decreases, frost tends to adhere to the outdoor heat exchanger. Therefore, in consideration of the outside air temperature, the start condition of the defrosting operation can be more accurately determined.

Second Embodiment

Figure 5A:
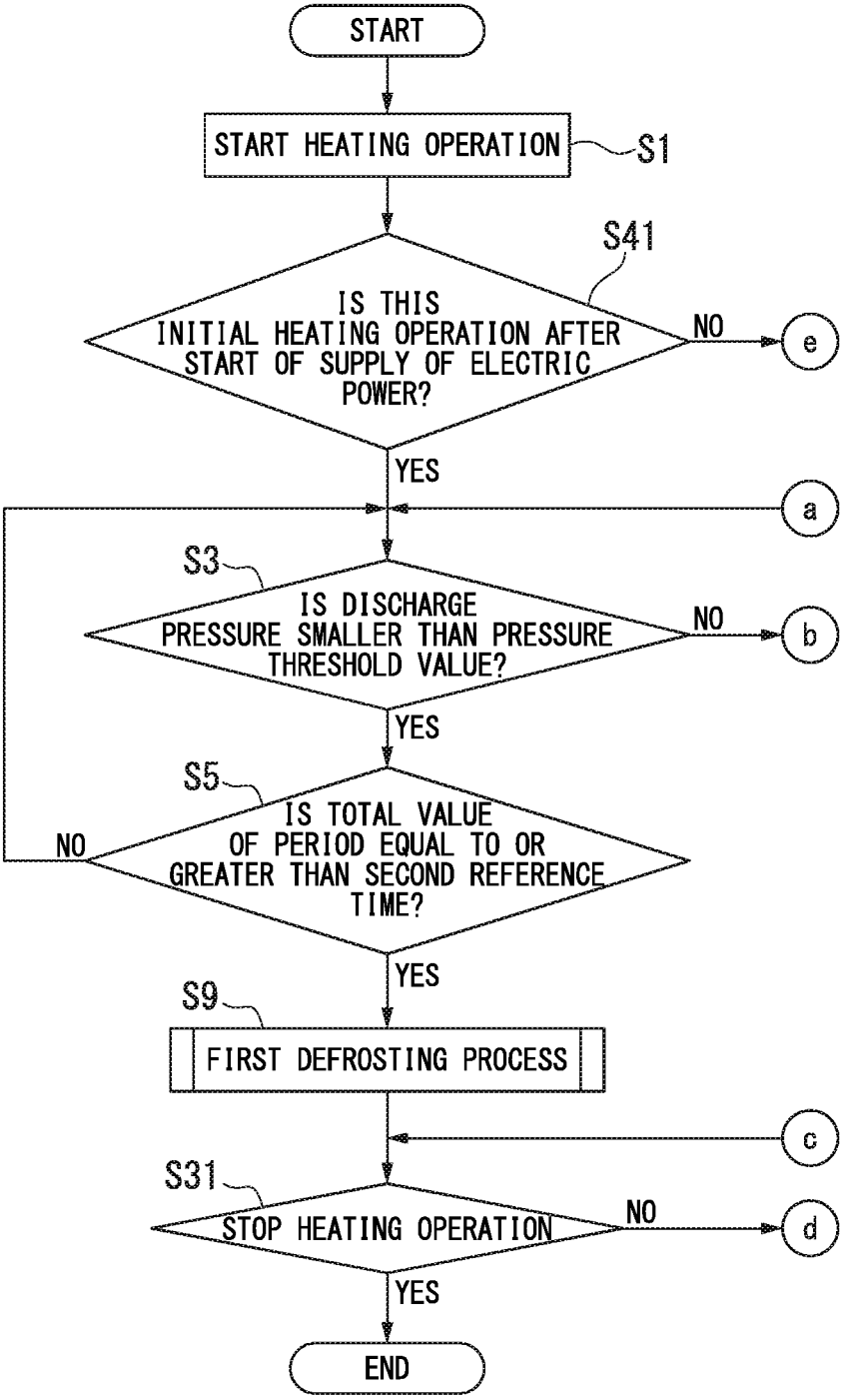
FIG. 5A is a flowchart for explaining an operation of an air conditioning apparatus of a second embodiment.
Figure 5B:
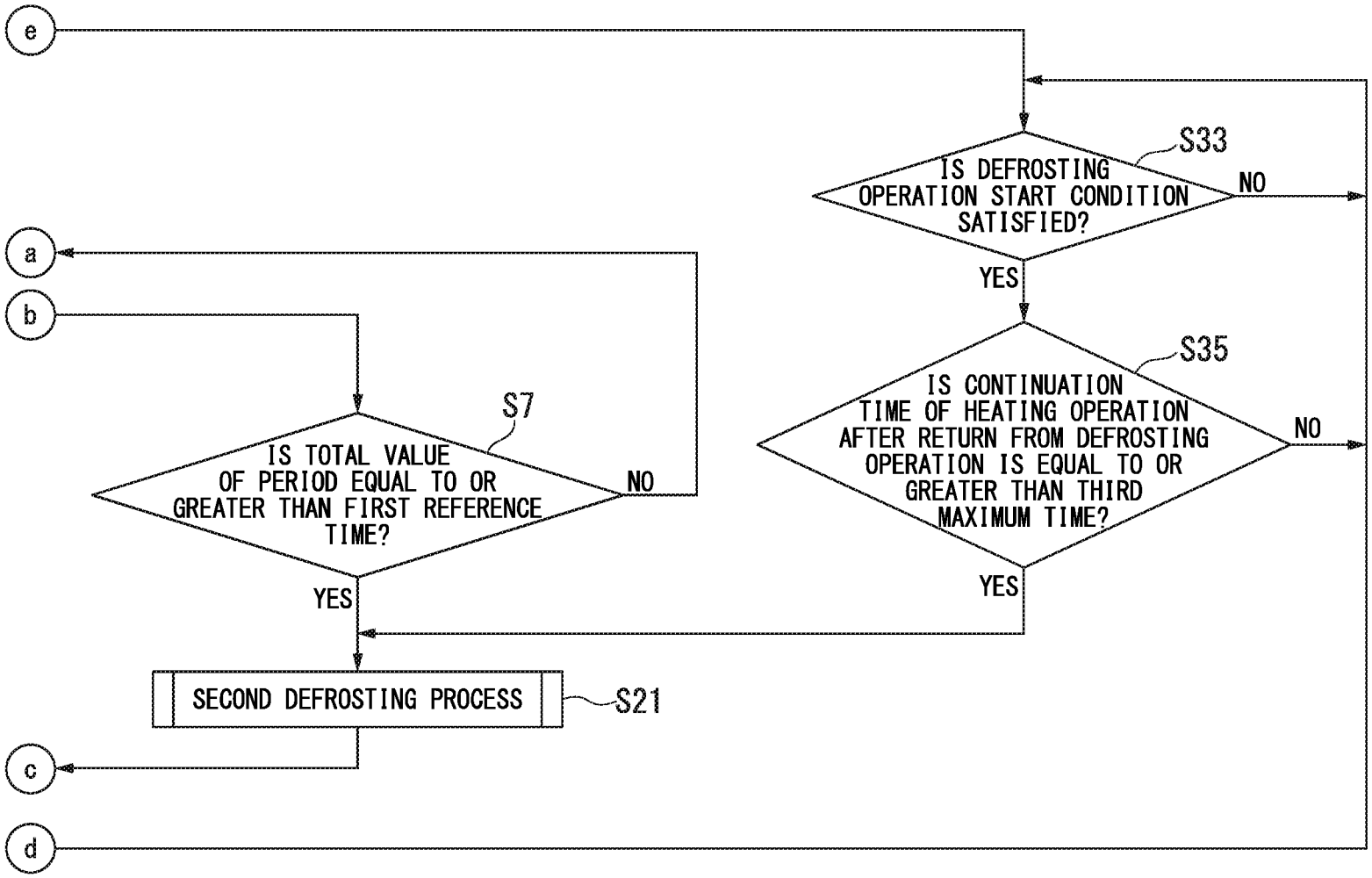
FIG. 5B is a flowchart showing the operation of the air conditioning apparatus of the second embodiment.

Next, a second embodiment will be described with reference to FIGS. 1, 5A, and 5B. Parts the same as those in the above embodiment are denoted by the same reference numerals, description thereof will be omitted, and only differences will be described.

As shown in FIG. 1, an air conditioning apparatus 2 of the present embodiment is equipped with a controller 51 instead of the controller 41 of the air conditioning apparatus 1 of the first embodiment. The second embodiment is different from the first embodiment in terms of only a control program for the controller 51 to control the arithmetic circuit 42 with respect to the controller 41.

In a memory 43 of the controller 51, information indicating whether or not the heating operation has been performed before the current time from start of supply of electric power to the controller 51 is stored. For example, by writing 'true (or 1)' at the address indicating the heating operation after supply of electric power in the memory 43, there is an indication that the heating operation has not been performed before the current time from the start of supply of electric power to the controller 51. By writing 'false (or 0)' at this address, there is an indication that the heating operation has been performed before the current time from the start of supply of electric power to the controller 51.

Next, the operation of the air conditioning apparatus 2 configured as described above will be described. FIGS. 5A and 5B are flowcharts for explaining the operation of the air conditioning apparatus 2.

First, the user inserts the plug 46 of the air conditioning apparatus 2 into the outlet. The supply of the electric power to the controller 51 is started. Since the supply of electric power to the controller 51 is started, 'True' is written at the address indicating the heating operation after the supply of electric power in the memory 43.

At the beginning of the supply of electric power to the controller 51, the start condition of the defrosting operation is that the total period during which the outside air temperature is less than the temperature threshold value T1 is the first reference time, for example, 40 minutes from the start of the heating operation. The maximum time of continuing the defrosting operation is the first maximum time which is, for example, 15 minutes.

In step S1 (see FIG. 5A), the user operates the input unit and instructs the arithmetic circuit 42 of the controller 41 to start the heating operation. The arithmetic circuit 42 reads the address indicating the heating operation after the supply of electric power in the memory 43. When step S1 is terminated, the process proceeds to step S41.

In step S41, the arithmetic circuit 42 determines whether the currently designated heating operation is the initial heating operation after the supply of electric power to the controller 51 is started. If the arithmetic circuit 42 determines that it is the initial heating operation after the start of supply of electric power (Yes) in step S41, the process proceeds to step S3. On the other hand, if the arithmetic circuit 42 determines that it is not the initial heating operation from the start of supply of electric power (No) in step S41, the process proceeds to step S33 (see FIG. 5B).

In this case, the arithmetic circuit 42 which has read the value of 'True' determines 'Yes' in step S41, and the process proceeds to step S3.

Further, if Yes is determined in step S3, the arithmetic circuit 42 may set the first reference time to a fourth reference time (e.g., 15 minutes) shorter than the first reference time and the second reference time. The maximum time for continuing the defrosting operation may be set to a fourth maximum time (e.g., 3 minutes) shorter than the first maximum time and the second maximum time, rather than the first maximum time.

As described above, in the air conditioning apparatus 2 of the present embodiment, even when the outside air temperature of the outdoor unit 26 is extremely low, reliability in the defrosting operation can be secured.

Furthermore, when the heating operation is the initial heating operation after the start of supply of electric power to the controller 51, the controller 51 sets the first reference time, which is compared with the total value of the period during which the outside air temperature is less than the temperature threshold value T1 from the start of heating operation, to a second reference time shorter than the first reference time.

In general, at the time of the initial heating operation after the supply of electric power to the controller 51 is started, the temperature of the compressor 29 or the like is low and the refrigerant is in a refrigerant stagnation state (the proportion of the liquid phase state in the refrigerant is high).

If the heating operation is performed while the refrigerant is in the refrigerant stagnation state, since there is a case where the discharge pressure is less than the pressure threshold value P1, the reference time or the maximum time is shortened. By performing the control in this manner, it is possible to secure the reliability in the defrosting operation of the air conditioning apparatus 1 even when the refrigerant is in the refrigerant stagnation state.

Third Embodiment

Next, although a third embodiment will be described with reference to FIG. 1, parts the same as those of the above embodiment are denoted by the same reference numerals, description thereof will be omitted, and only differences will be described.

As shown in FIG. 1, the air conditioning apparatus 3 of the present embodiment is equipped with a controller 61, instead of the controller 41 of the air conditioning apparatus 1 of the first embodiment. The third embodiment is different from the first embodiment in terms of only a control program for the controller 61 to control the arithmetic circuit 42 with respect to the controller 41.

Information indicating whether or not the heating operation has been performed before the current time after the previous cooling operation was performed is stored in the memory 43 of the controller 61. For example, 'true' may be written at the address indicating the heating operation after the cooling operation in the memory 43, thereby indicating that the heating operation has not been performed after the previous cooling operation was performed. 'False' may be written at this address, thereby indicating that the heating operation has been performed before the current time after the previous cooling operation was performed.

Next, the operation of the air conditioning apparatus 3 configured as described above will be described.

First, the user inserts the plug 46 of the air conditioning apparatus 3 into the outlet. The supply of electric power to the controller 61 is started.

At the beginning of the start of supply of electric power to the controller 61, the start condition of the defrosting operation is that the total period during which the outside air temperature is less than the temperature threshold value T1 becomes the first reference time, which is, for example, 40 minutes, from the start of the heating operation. The maximum time for continuing the defrosting operation is the first maximum time which is, for example, 15 minutes.

For example, the user operates the input unit to perform the cooling operation in summer or the like.

The user manipulates the input unit in winter or the like to instruct the arithmetic circuit 42 of the controller 61 to start the heating operation. During the period from the summer season to the winter season, electric power is continuously supplied to the controller 61.

The arithmetic circuit 42 reads the address indicating the heating operation after the cooling operation in the memory 43, and determines that the heating operation has not been performed before the current time after the previous cooling operation was performed. That is, it is determined that the currently designated heating operation is the initial heating operation after the previous cooling operation was performed.

When the discharge pressure is less than the pressure threshold value P1 while the heating operation is performed, the arithmetic circuit 42 of the controller 61 sets the first reference time, which is compared with the total value of the period during which the outside air temperature is less than the temperature threshold value T1 from the start of the heating operation, to the second reference time (for example, 20 minutes) shorter than the first reference time. Further, the arithmetic circuit 42 shortens the maximum time for continuing the defrosting operation from the first maximum time to the second maximum time (for example, 5 minutes).

In this case, the start condition of the defrosting operation is that the total value of the period during which the outside air temperature is less than the temperature threshold value T1 from the start of the heating operation becomes the second reference time.

When the discharge pressure is equal to or higher than the pressure threshold value P1 at all times when the heating operation is performed, the arithmetic circuit 42 does not change the first reference time compared with the total value of the period during which the outside air temperature is less than the temperature threshold value T1. Further, the arithmetic circuit 42 does not change the maximum time for continuing the defrosting operation from the first maximum time.

Further, in a case where it is determined that the currently instructed heating operation is the initial heating operation after the previous cooling operation was performed, the controller 61 may set the first reference time to a fourth reference time (e.g., 15 minutes) which is shorter than the first reference time and the second reference time. The arithmetic circuit 42 may set the maximum time for continuing the defrosting operation to a fourth maximum time (e.g., 3 minutes), which is shorter than the first maximum time and the second maximum time, rather than the first maximum time.

When the start condition of the defrosting operation is satisfied, the controller 61 starts the defrosting operation. The maximum time for continuing the defrosting operation in this case is the second reference time.

As described above, in the air conditioning apparatus 3 of the present embodiment, even when the outside air temperature of the outdoor unit 26 is extremely low, reliability in the defrosting operation can be secured.

Further, when the initial heating operation is performed after the previous heating operation is performed, the controller 61 sets the first reference time, which is compared with the total value of the period during which the outside air temperature is less than the temperature threshold value T1 from the start of the heating operation, to the second reference time shorter than the first reference time.

Generally, at the time of the initial heating operation after the previous cooling operation is performed, the temperature of the compressor 29 or the like is low, and the refrigerant is in a refrigerant stagnation state. If the heating operation is performed when the refrigerant is in the refrigerant stagnation state, in some cases, the discharge pressure may become less than the pressure threshold value P1. Accordingly, the controller 61 shortens the reference time or the maximum time. By performing the control in this way, it is possible to ensure reliability in the defrosting operation of the air conditioning apparatus 3 even when the refrigerant is in the refrigerant stagnation state.

Further, in the aforementioned first to third embodiments, when the outside air temperature of the outdoor unit in which the air conditioning apparatus is used is limited to a very low temperature or the like, the air conditioning apparatus may be equipped with the outside air temperature sensor 36. In this case, the start condition of the defrosting operation is that the total value of the period from the start of the heating operation becomes the first reference time.

In the aforementioned first to third embodiments, the air conditioning apparatus is equipped with the two indoor units 11A and 11B. However, the number of indoor units with which the air conditioning apparatus is equipped is not limited to two, and the number may be one or three or more.

In the aforementioned first to third embodiments, the air conditioning apparatus may be equipped with the outdoor expansion valve 30 and the accumulator 38.

According to at least one embodiment described above, when the discharge pressure is less than the pressure threshold value P1 while the heating operation is being performed, the controllers 41, 51, and 61 sets the maximum time for continuing the defrosting operation started when the start condition of the defrosting operation is satisfied to be shorter than the maximum time for continuing the defrosting operation when the discharge pressure is equal to or higher than the pressure threshold value P1, which makes it possible to secure the reliability in the defrosting operation even when the outside air temperature of the outdoor unit 26 is extremely low.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioning apparatus comprising:

one or a plurality of indoor units each having an indoor heat exchanger, and an indoor expansion valve in which a degree of opening is variable;

an outdoor unit having an outdoor heat exchanger, a four-way valve, a compressor, a discharge pressure sensor configured to detect a pressure of a refrigerant discharged from the compressor, and a temperature sensor configured to detect a temperature of outside air; and a controller configured to control each indoor expansion valve, the four-way valve, and the compressor, the controller configured to store a total value of a period during which a temperature detected by the temperature sensor is less than a predetermined temperature threshold value after a start of a heating operation, the controller configured to determine whether or not the total value of the period is equal to or greater than a predetermined reference time, the controller configured to determine whether or not a discharge pressure detected by the discharge pressure sensor is equal to or higher than a predetermined pressure threshold value, wherein the one or plurality of indoor units are connected to the outdoor unit, wherein the controller is configured to start a defrosting operation when the total value of the period becomes equal to or greater than the reference time, wherein the controller is configured such that when the controller determines that the discharge pressure is equal to or higher than the pressure threshold value while the heating operation is performed, the controller sets a maximum time for continuing the defrosting operation to a first maximum time, and wherein the controller is configured such that when the controller determines that the discharge pressure is less than the pressure threshold value while the heating operation is performed, the controller sets the maximum time for continuing the defrosting operation to a second maximum time shorter than the first maximum time.

2. The air conditioning apparatus according to claim 1, wherein the controller is configured to set the reference time to a first reference time when the controller determines the discharge pressure is equal to or more than the pressure threshold value while performing the heating operation, and wherein the controller is configured to set the reference time to a second reference time shorter than the first reference time when the controller determines the discharge pressure is less than the pressure threshold value while performing the heating operation.

3. The air conditioning apparatus according to claim 1, wherein the controller is configured to set the maximum time for continuing the defrosting operation to a third maximum time shorter than the second maximum time in a case where the controller determines the discharge pressure detected by the discharge pressure sensor is less than the pressure threshold value[H] while performing the heating operation when the heating operation is the initial heating operation after a cooling operation is performed.

* * * * *